US011841013B2

(12) United States Patent
Bou Dargham et al.

(10) Patent No.: US 11,841,013 B2
(45) Date of Patent: Dec. 12, 2023

(54) SCROLL COMPRESSOR INCLUDING A FIRST AND A SECOND AXIAL STABILIZING ARRANGEMENT

(71) Applicant: DANFOSS COMMERCIAL COMPRESSORS, Trevoux (FR)

(72) Inventors: Remi Bou Dargham, Nordborg (DK); Arnaud Daussin, Nordborg (DK); David Genevois, Nordborg (DK)

(73) Assignee: Danfoss Commercial Compressors, Trevoux (FR)

( * ) Notice: Subject to any disclaimer, the term of this patent is extended or adjusted under 35 U.S.C. 154(b) by 31 days.

(21) Appl. No.: 17/771,851

(22) PCT Filed: Nov. 2, 2020

(86) PCT No.: PCT/EP2020/080694

§ 371 (c)(1),
(2) Date: Apr. 26, 2022

(87) PCT Pub. No.: WO2021/089486

PCT Pub. Date: May 14, 2021

(65) Prior Publication Data

US 2022/0372975 A1 Nov. 24, 2022

(30) Foreign Application Priority Data

Nov. 4, 2019 (FR) ..... 19/12341

(51) Int. Cl.
*F04C 18/02* (2006.01)
*F04C 23/00* (2006.01)

(52) U.S. Cl.
CPC ..... *F04C 18/0215* (2013.01); *F04C 18/0284* (2013.01); *F04C 23/008* (2013.01)

(58) Field of Classification Search
CPC ..... F04C 15/06; F04C 23/00; F04C 18/0215; F04C 29/04; F04C 2240/30;
(Continued)

(56) References Cited

U.S. PATENT DOCUMENTS 3,994,633 A * 11/1976 Shaffer ..... F01C 1/0215 418/55.6
5,330,335 A * 7/1994 Teracuhi ..... F04C 29/025 418/55.6
(Continued)

FOREIGN PATENT DOCUMENTS

JP H09-158850 A 6/1997
JP H-09158850 A * 6/1997 ..... F04C 18/0223
WO 2009/096206 A1 8/2009

OTHER PUBLICATIONS

English Translation JPH-09158850-A (Year: 1997).*
(Continued)

*Primary Examiner* — Shafiq Mian
(74) *Attorney, Agent, or Firm* — McCormick, Paulding & Huber PLLC

(57) ABSTRACT

The scroll compressor includes a fixed scroll (8) having a fixed end plate (11) and a fixed spiral wrap (12) extending from the fixed end plate (11); an orbiting scroll (9) having an orbiting base plate (14) and an orbiting spiral wrap (15) extending from a first face of the orbiting base plate (14), the orbiting spiral wrap (15) of the orbiting scroll (9) meshing with the fixed spiral wrap (12) of the fixed scroll (8) to form compression chambers (18), the orbiting base plate (14) having a flange portion (16) radially extending on at least part of the circumference of the orbiting base plate (14) and beyond an outer wall surface of the orbiting spiral wrap (15); and a first and a second axial stabilizing arrangement (29, 31) configured to axially stabilize the orbiting scroll (9), the first axial stabilizing arrangement (29) being formed
(Continued)

between the flange portion (16) of the orbiting base plate (14) and the fixed scroll (8), and the second axial stabilizing arrangement (31) being formed between a portion of the orbiting spiral wrap (15) of the orbiting scroll (9) and the fixed end plate (11) of the fixed scroll (8).

16 Claims, 8 Drawing Sheets

(58) Field of Classification Search
CPC ..... F04C 2240/40; F04C 2240/60; F04C 2240/50; F04C 2240/10
See application file for complete search history.

(56) References Cited

U.S. PATENT DOCUMENTS 6,425,746 B1 * 7/2002 Mori ..... F04C 18/0223 418/55.4
2006/0216180 A1 * 9/2006 Yanagisawa ..... F01C 11/002 418/55.1
2010/0158710 A1 * 6/2010 Umemura ..... F04C 27/005 417/310
2012/0275946 A1 * 11/2012 Seong ..... F04C 23/008 418/55.1
2017/0067467 A1 * 3/2017 Lee ..... F04C 23/008

OTHER PUBLICATIONS

International Search Report dated Jan. 22, 2021, in connection with corresponding International application No. PCT/EP2020/080694; 3 pages.

First Examination Report for Indian Patent Application No. 202217014357 dated Jul. 5, 2022.

* cited by examiner

[Fig 6]
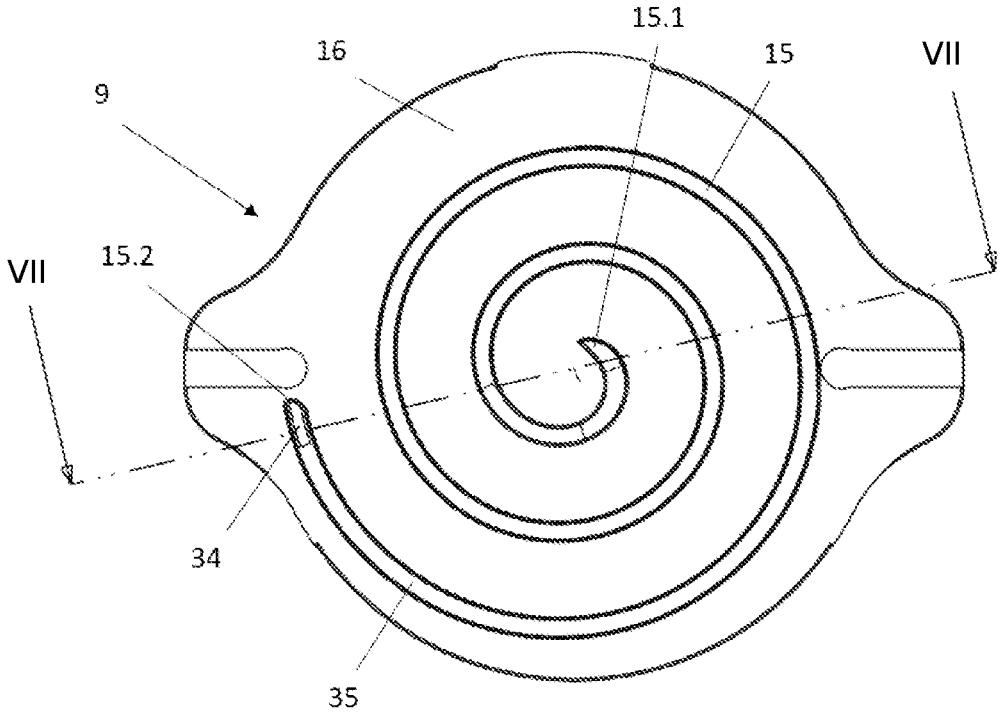
[Fig 7]
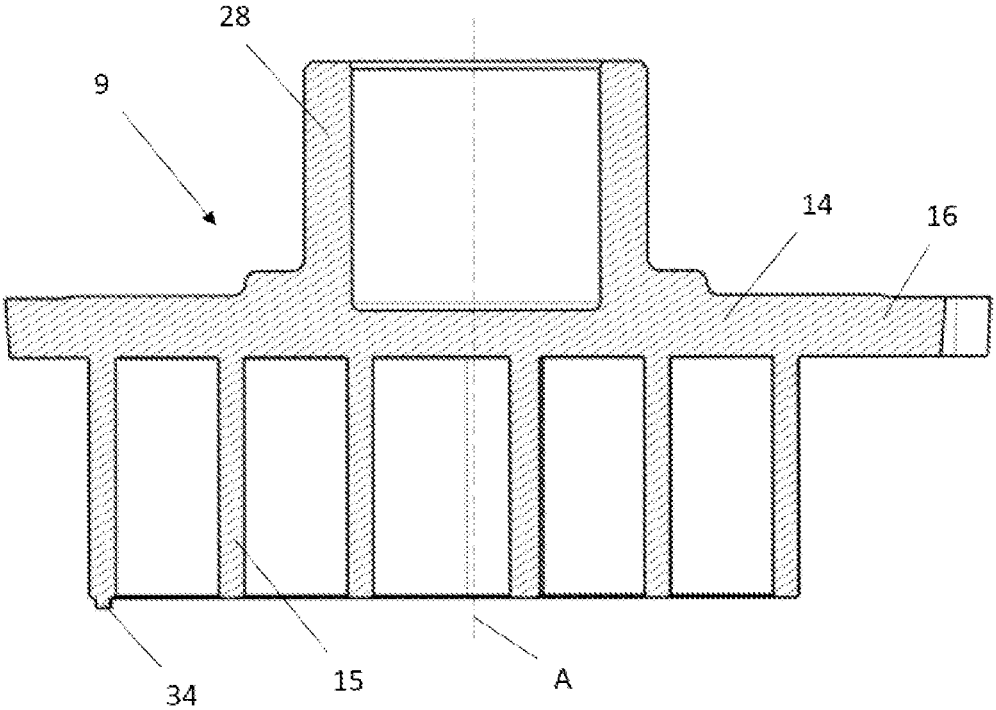

SCROLL COMPRESSOR INCLUDING A FIRST AND A SECOND AXIAL STABILIZING ARRANGEMENT

CROSS-REFERENCE TO RELATED APPLICATION

This application is a National Stage application of International Patent Application No. PCT/EP2020/080694, filed on Nov. 2, 2020, which claims priority to French Application No. 19/12341, filed on Nov. 4, 2019, each of which is hereby incorporated by reference in its entirety.

TECHNICAL FIELD

The present invention relates to a scroll compressor, and in particular to a scroll refrigeration compressor.

BACKGROUND

As known, a scroll compressor comprises:

a fixed scroll having a fixed end plate and a fixed spiral wrap extending from the fixed end plate, and an orbiting scroll having an orbiting base plate and an orbiting spiral wrap extending from the orbiting base plate, the orbiting spiral wrap of the orbiting scroll meshing with the fixed spiral wrap of the fixed scroll to form compression chambers, the orbiting base plate comprising a flange portion radially extending on at least part of the circumference of the orbiting base plate and beyond an outer wall surface of the orbiting spiral wrap.

Generally, the orbiting scroll of a scroll compressor has a tendency to perform a tilting or wobble movement during compressor operation. This is due to a tilting moment resulting from different forces acting on the orbiting scroll at different axial and/or radial positions, such as gas forces in the compression chambers or frictional forces generated in various bearings of the scroll compressor. In dual scroll compressors, another source for tilting moments may be pressure differences in corresponding chambers on both sides of the orbiting base plate of the orbiting scroll.

To solve this wobbling problem, it is known from JP09-158850A to provide the scroll compressor with a first axial stabilizing arrangement including a first ring-shaped wall structure which extends from the fixed end plate of the fixed scroll, which surrounds the fixed spiral wrap and which includes an axial end face engaged with an axial surface on a first side of the flange portion of the orbiting base plate, and with a second axial stabilizing arrangement including a second ring-shaped wall structure which extends from an additional fixed end plate of an additional fixed scroll, which surrounds an additional fixed spiral wrap of the additional fixed scroll and which includes an axial end face engaged with an axial surface on a second side of the flange portion of the orbiting base plate.

Such axial stabilizing arrangements require a certain space radially outside the fixed and orbiting spiral wraps and therefore limit the available volume of the compression chambers in a given compressor casing.

In addition, with the use of new low global warming refrigerants having lower density than present refrigerants, there is a need to increase the volume flow of refrigerant through the scroll compressor to maintain the same cooling capacity. One way is to increase the volume of the compression chambers between the cooperating scroll elements. However, such an increase of the volume of the compression chambers particularly leads to an increase of the scroll elements' outer diameters if an axial stabilizing arrangement as previously disclosed is provided on the fixed scroll, which is detrimental for the compressor compactness.

SUMMARY

It is an object of the present invention to provide an improved scroll compressor which can overcome the drawbacks encountered in conventional scroll compressors.

Another object of the present invention is to provide a scroll compressor with an increased volume flow, while cancelling or substantially limiting the tilting movement of the orbiting scroll during compressor operation and maintaining a given outer diameter of the compressor casing.

According to the invention such a scroll compressor comprises:

a fixed scroll having a fixed end plate and a fixed spiral wrap extending from the fixed end plate, an orbiting scroll having an orbiting base plate and an orbiting spiral wrap extending from a first face of the orbiting base plate, the orbiting spiral wrap of the orbiting scroll meshing with the fixed spiral wrap of the fixed scroll to form compression chambers, the orbiting base plate comprising a flange portion radially extending on at least part of the circumference of the orbiting base plate and beyond an outer wall surface of the orbiting spiral wrap, wherein the scroll compressor further comprises a first and a second axial stabilizing arrangement configured to axially stabilize the orbiting scroll, the first axial stabilizing arrangement being formed between the flange portion of the orbiting base plate and the fixed scroll, and the second axial stabilizing arrangement being formed between a portion of the orbiting spiral wrap of the orbiting scroll and the fixed end plate of the fixed scroll.

Such a configuration of the first and second axial stabilizing arrangements substantially limits the tilting of the orbiting scroll without requiring the provision of an annular stabilizing structure on the fixed scroll. Therefore, such a configuration of the first and second axial stabilizing arrangements allows to increase the volume flow of the scroll compressor without increasing the scroll elements' outer diameters, and thus while maintaining a given outer diameter of the compressor casing.

Further, such a configuration of the first and second axial stabilizing arrangements does not require to proceed to major change on the orbiting and fixed scrolls.

The scroll compressor may also include one or more of the following features, taken alone or in combination.

According to an embodiment of the invention, the fixed scroll includes an outer peripheral wall extending from the fixed end plate and surrounding the fixed spiral wrap.

According to an embodiment of the invention, the first axial stabilizing arrangement is formed between the flange portion of the orbiting base plate and the outer peripheral wall of the fixed scroll.

According to an embodiment of the invention, the first axial stabilizing arrangement includes at least one first stabilizer pad formed on the flange portion of the orbiting base plate and/or on the outer peripheral wall of the fixed scroll.

According to an embodiment of the invention, the at least one first stabilizer pad is formed on an axial surface of the outer peripheral wall of the fixed scroll, and is configured to cooperate with an axial surface on a first side of the flange portion of the orbiting base plate.

According to an embodiment of the invention, the at least one first stabilizer pad is formed on an axial surface on the first side of the flange portion of the orbiting base plate, and is configured to cooperate with an axial surface of the outer peripheral wall of the fixed scroll.

According to an embodiment of the invention, the at least one first stabilizer pad includes two first stabilizer pads arranged at a predetermined circumferential distance.

According to an embodiment of the invention, the first axial stabilizing arrangement is formed between the flange portion of the orbiting base plate and a portion of the fixed spiral wrap of the fixed scroll.

According to an embodiment of the invention, the first axial stabilizing arrangement includes at least one first stabilizer pad which is formed on an axial surface of the fixed spiral wrap of the fixed scroll, and which is configured to cooperate with an axial surface on the first side of the flange portion of the orbiting base plate.

According to an embodiment of the invention, the at least one first stabilizer pad includes a single first stabilizer pad which is arranged near an outer end of the fixed spiral wrap.

According to an embodiment of the invention, the single first stabilizer pad is arranged in a portion of the axial end face of the fixed spiral wrap, where no tip seal groove is formed.

According to an embodiment of the invention, the at least one first stabilizer pad is integrally formed with the fixed scroll and is a surface area elevated from the surrounding surface of the fixed scroll.

According to an embodiment of the invention, the at least one first stabilizer pad is formed as a separate part attached to the fixed scroll, for example by welding, brazing, gluing, coating or other deposition methods.

According to an embodiment of the invention, the first axial stabilizing arrangement includes at least one first stabilizer pad which is formed on an axial surface on the first side of the flange portion of the orbiting base plate, and is configured to cooperate with an axial surface of the fixed spiral wrap of the fixed scroll.

According to an embodiment of the invention, the flange portion of the orbiting base plate is annular.

According to an embodiment of the invention, the second axial stabilizing arrangement is arranged at a position substantially opposite to the position of the first axial stabilizing arrangement in relation to a center axis of the orbiting scroll. Such a configuration of the first and second axial stabilizing arrangements substantially improves the axial stability of the orbiting scroll.

According to an embodiment of the invention, the second axial stabilizing arrangement includes at least one second stabilizer pad which is formed on an axial surface of the orbiting spiral wrap of the orbiting scroll, and which is configured to cooperate with a bottom surface of the fixed end plate.

According to an embodiment of the invention, the at least one second stabilizer pad includes a single second stabilizer pad which is arranged near an outer end of the orbiting spiral wrap.

According to an embodiment of the invention, the single second stabilizer pad is arranged in a portion of the axial end face of the orbiting spiral wrap, where no tip seal groove is formed.

According to an embodiment of the invention, the single second stabilizer pad of the second axial stabilizing arrangement is arranged at a position substantially opposite to the position of the first axial stabilizing arrangement in relation to a center axis of the orbiting scroll.

According to an embodiment of the invention, the at least one second stabilizer pad is integrally formed with the orbiting spiral wrap and is a surface area elevated from the surrounding surface of the orbiting spiral wrap.

According to an embodiment of the invention, the at least one second stabilizer pad is formed as a separate part attached to the orbiting spiral wrap, for example by welding, brazing, gluing, coating or other deposition methods.

According to an embodiment of the invention, the second axial stabilizing arrangement includes at least one second stabilizer pad which is formed on a bottom surface of the fixed end plate, and which is configured to cooperate with an axial surface of the orbiting spiral wrap of the orbiting scroll.

According to an embodiment of the invention, the scroll compressor includes a single compression stage.

According to an embodiment of the invention, the scroll compressor is a dual scroll compressor and includes two compression stages.

According to an embodiment of the invention, the scroll compressor further comprises an additional fixed scroll having an additional fixed end plate and an additional fixed spiral wrap extending from the additional fixed end plate, the orbiting scroll having an additional orbiting spiral wrap which extends from a second face of the orbiting base plate, and which meshes with the additional fixed spiral wrap of the additional fixed scroll to form compression chambers.

According to an embodiment of the invention, the scroll compressor further comprises a third and a fourth axial stabilizing arrangement configured to axially stabilize the orbiting scroll, the third axial stabilizing arrangement being formed between the flange portion of the orbiting base plate and the additional fixed scroll, and the fourth axial stabilizing arrangement being formed between a portion of the additional orbiting spiral wrap of the orbiting scroll and the additional fixed end plate of the additional fixed scroll.

According to an embodiment of the invention, the flange portion radially extends beyond an outer wall surface of the additional orbiting spiral wrap.

According to an embodiment of the invention, the fourth axial stabilizing arrangement is arranged at a position substantially opposite to the position of the third axial stabilizing arrangement in relation to the center axis of the orbiting scroll.

According to an embodiment of the invention, the additional fixed scroll includes an outer peripheral wall extending from the additional fixed end plate and surrounding the additional fixed spiral wrap.

According to an embodiment of the invention, the third axial stabilizing arrangement is formed between the flange portion of the orbiting base plate and the outer peripheral wall of the additional fixed scroll.

According to an embodiment of the invention, the third axial stabilizing arrangement includes at least one third stabilizer pad formed on the flange portion of the orbiting base plate and/or on the outer peripheral wall of the additional fixed scroll.

According to an embodiment of the invention, the at least one third stabilizer pad is formed on an axial surface of the outer peripheral wall of the additional fixed scroll, and is configured to cooperate with an axial surface on a second side of the flange portion of the orbiting base plate.

According to an embodiment of the invention, the at least one third stabilizer pad is integrally formed with the additional fixed scroll and is a surface area elevated from the surrounding surface of the additional fixed scroll.

According to an embodiment of the invention, the at least one third stabilizer pad is formed as a separate part attached to the additional fixed scroll, for example by welding, brazing, gluing, coating or other deposition methods.

According to an embodiment of the invention, the at least one third stabilizer pad is formed on an axial surface on the second side of the flange portion of the orbiting base plate, and is configured to cooperate with an axial surface of the outer peripheral wall of the additional fixed scroll.

According to an embodiment of the invention, the at least one third stabilizer pad includes a single third stabilizer pad.

According to an embodiment of the invention, the at least one third stabilizer pad includes two third stabilizer pads arranged at a predetermined circumferential distance.

According to an embodiment of the invention, the fourth axial stabilizing arrangement includes at least one fourth stabilizer pad which is formed on an axial surface of the additional orbiting spiral wrap of the orbiting scroll, and which is configured to cooperate with a bottom surface of the additional fixed end plate.

According to an embodiment of the invention, the at least one fourth stabilizer pad includes a single fourth stabilizer pad which is arranged near an outer end of the additional orbiting spiral wrap.

According to an embodiment of the invention, the single fourth stabilizer pad is arranged in a portion of the axial end face of the additional orbiting spiral wrap, where no tip seal groove is formed.

According to an embodiment of the invention, the single fourth stabilizer pad of the fourth axial stabilizing arrangement is arranged at a position substantially opposite to the position of the third axial stabilizing arrangement in relation to the center axis of the orbiting scroll.

According to an embodiment of the invention, the at least one fourth stabilizer pad is integrally formed with the additional orbiting spiral wrap and is a surface area elevated from the surrounding surface of the additional orbiting spiral wrap.

According to an embodiment of the invention, the at least one fourth stabilizer pad is formed as a separate part attached to the additional orbiting spiral wrap, for example by welding, brazing, gluing, coating or other deposition methods.

According to an embodiment of the invention, the fourth axial stabilizing arrangement includes at least one fourth stabilizer pad which is formed on a bottom surface of the additional fixed end plate, and which is configured to cooperate with an axial surface of the additional orbiting spiral wrap of the orbiting scroll.

According to an embodiment of the invention, the fixed scroll and the additional fixed scroll are attached to each other and delimit an inner volume, the orbiting scroll being arranged within the inner volume.

According to an embodiment of the invention, the first and third axial stabilizing arrangements are axially offset relative to each other and are located substantially at a same angular position with respect to the center axis of the fixed scroll.

According to an embodiment of the invention, the second and fourth axial stabilizing arrangements are axially offset relative to each other and are located substantially at a same angular position with respect to the center axis of the orbiting scroll.

According to an embodiment of the invention, an axial clearance (C) between the second axial stabilizing arrangement and a respective axial facing surface of the fixed scroll or of the orbiting scroll is expressed with following equation:

$$0 \leq C < T,$$

where T is an axial clearance between an axial end face of the orbiting spiral wrap and a respective axial facing surface of the fixed end plate. Such a configuration of the scroll compressor ensures a proper operation of the scroll compressor and avoids of wobbling.

According to an embodiment of the invention, the scroll compressor further comprises a hermetic casing comprising a suction inlet and a discharge outlet.

According to an embodiment of the invention, the scroll compressor further comprises a drive shaft connected to a rotor of an electrical motor arranged within the hermetic casing.

According to an embodiment of the invention, the orbiting scroll is driven by an eccentric portion of the drive shaft engaging a cylindrical connecting sleeve part formed on the orbiting scroll along the central axis of the orbiting scroll.

According to an embodiment of the invention, the scroll compressor further comprises a rotation preventing mechanism configured to assure an orbiting movement of the orbiting scroll in relation to the fixed scroll.

According to an embodiment of the invention, the scroll compressor further comprises a suction inlet opening formed in the outer peripheral wall of the fixed scroll and an additional suction inlet opening formed in the outer peripheral wall of the additional fixed scroll to supply refrigerant gas to the compression chambers.

According to an embodiment of the invention, the scroll compressor further comprises a discharge opening formed in the fixed end plate of the fixed scroll at a position near an inner end of the orbiting spiral wrap to discharge compressed refrigerant.

According to an embodiment of the invention, the scroll compressor further comprises an additional discharge opening formed in the additional fixed end plate of the additional fixed scroll at a position near an inner end of the additional orbiting spiral wrap to discharge compressed refrigerant.

These and other advantages will become apparent upon reading the following description in view of the drawing attached hereto representing, as non-limiting examples, two embodiments of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

FIG. 6 is an upper view of an orbiting scroll of the scroll compressor of FIG. 1.

FIG. 7 is a section view according to line VII-VII of FIG. 6.

DETAILED DESCRIPTION

Figure 1:
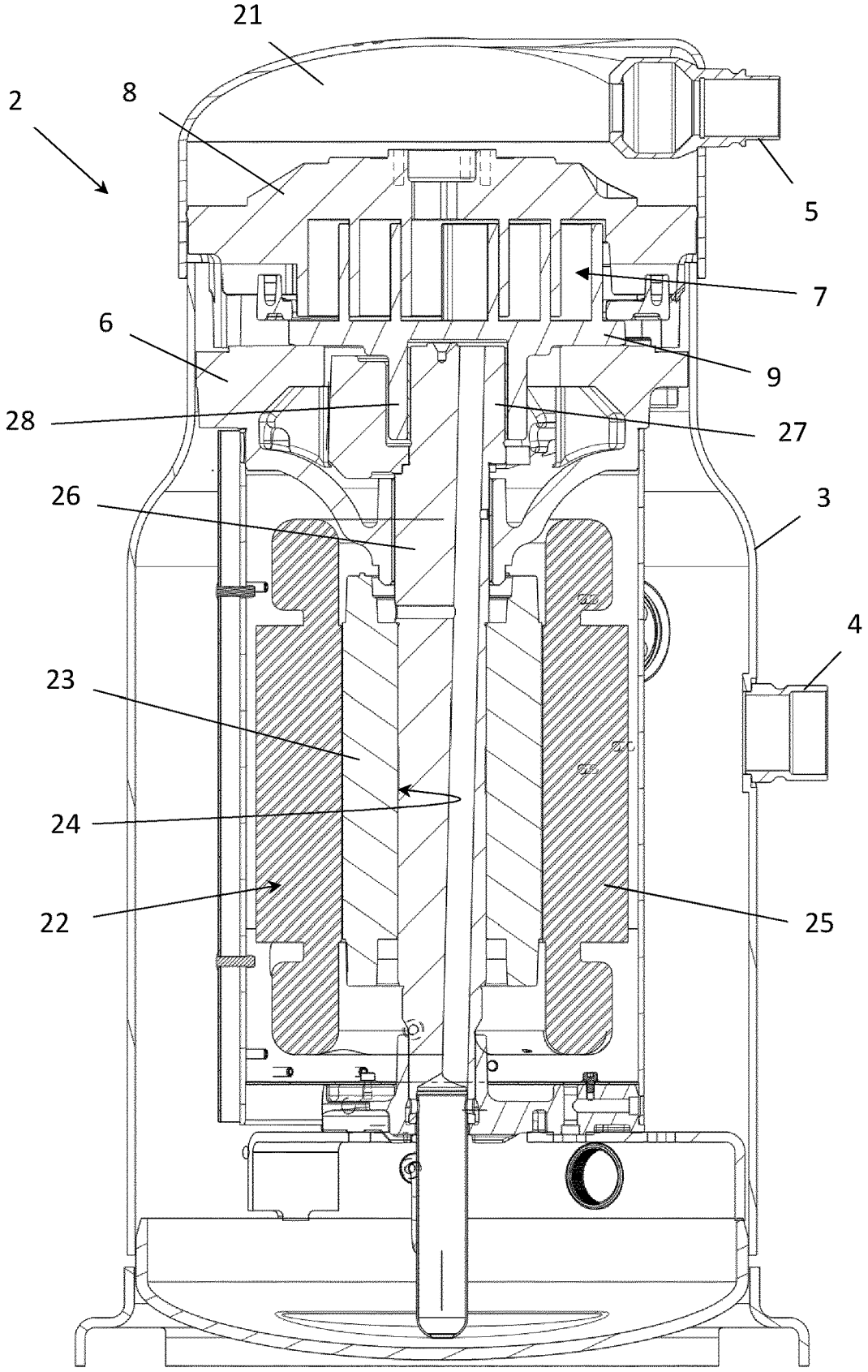
FIG. 1 is a longitudinal section view of a scroll compressor according to a first embodiment of the invention.

FIG. 1 shows a scroll compressor 2 comprising a hermetic casing 3 provided with a suction inlet 4 configured to supply the scroll compressor 2 with refrigerant to be compressed, and with a discharge outlet 5 configured to discharge compressed refrigerant.

The scroll compressor 2 also comprises a support frame 6 arranged within the hermetic casing 3 and secured to the hermetic casing 3, and a compression unit 7 also arranged within the hermetic casing 3 and disposed above the support frame 6. The compression unit 7 is configured to compress the refrigerant supplied by the suction inlet 4, and includes a fixed scroll 8 and an orbiting scroll 9 interfitting with each other. In particular, the orbiting scroll 9 is supported by and in slidable contact with an upper face of the support frame 6, and the fixed scroll 8 is fixed in relation to the hermetic casing 3.

The fixed scroll 8 has a fixed end plate 11, a fixed spiral wrap 12 projecting from the fixed end plate 11 towards the orbiting scroll 9, and an outer peripheral wall 13 extending from the fixed end plate 11 and surrounding the fixed spiral wrap 12.

The orbiting scroll 9 has an orbiting base plate 14 and an orbiting spiral wrap 15 projecting from a first face 14.1 of the orbiting base plate 14 towards the fixed scroll 8. The orbiting base plate 14 includes a flange portion 16 radially extending on the circumference of the orbiting base plate 14 and beyond an outer wall surface 17 of the orbiting spiral wrap 15. According to the first embodiment of the invention, the flange portion 16 of the orbiting base plate 14 is annular.

The orbiting spiral wrap 15 of the orbiting scroll 9 meshes with the fixed spiral wrap 12 of the fixed scroll 8 to form a plurality of compression chambers 18 between them. The compression chambers 18 have a variable volume which decreases from the outside towards the inside, when the orbiting scroll 9 is driven to orbit relative to the fixed scroll 8.

The scroll compressor 2 further comprises a suction inlet opening 19 formed in the outer peripheral wall 13 of the fixed scroll 8 to supply refrigerant to the compression chambers 18. The refrigerant compressed in the compression chambers 18 escapes from the compression unit 7 through a discharge opening 20 formed in the fixed end plate 11 of the fixed scroll 8 at a position near an inner end 15.1 of the orbiting spiral wrap 15 and leading to a high-pressure chamber 21, from which the compressed refrigerant is discharged by the discharge outlet 5.

The scroll compressor 2 further comprises an electric motor 22 disposed below the support frame 6. The electric motor has a rotor 23 provided with an axial through passage 24, and a stator 25 disposed around the rotor 23.

Furthermore the scroll compressor 2 comprises a drive shaft 26 connected to the rotor 23 of the electrical motor 22 and configured to drive the orbiting scroll 9 in an orbital movement. Particularly, the drive shaft 26 comprises, at its top end, an eccentric pin 27 which is off-centered from the center of the drive shaft 26, and which is inserted in a connecting sleeve part 28 of the orbiting scroll 9 so as to cause the orbiting scroll 9 to be driven in an orbital movement relative to a fixed scroll 8 when the electric motor 22 is operated. The connecting sleeve part 28 particularly projects from a second face 14.2 of the orbiting base plate 14.

The scroll compressor 2 further comprises a first and a second axial stabilizing arrangement 29, 31 configured to axially stabilize the orbiting scroll 9.

Figure 2:
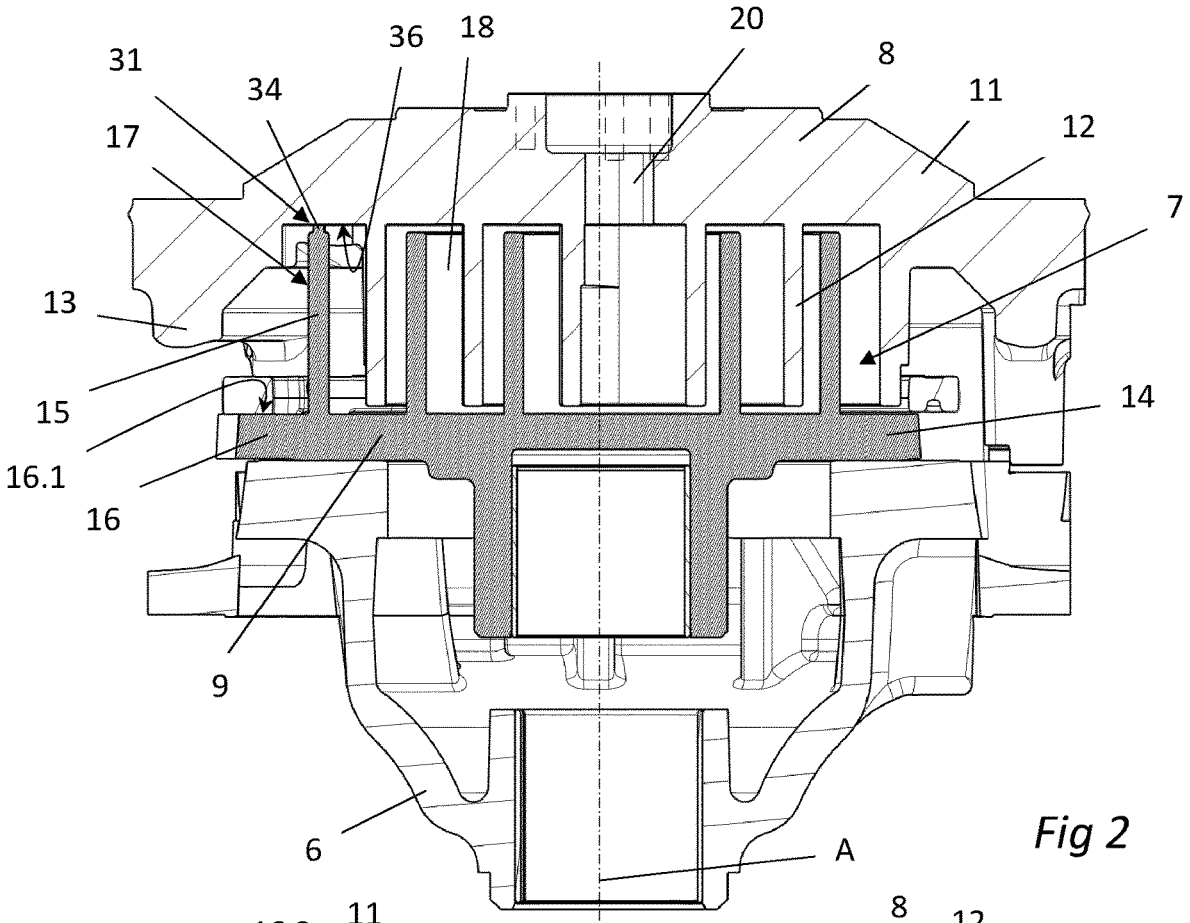
FIG. 2 is a partial longitudinal section view of the scroll compressor of FIG. 1 along a first section plan.
Figure 3:
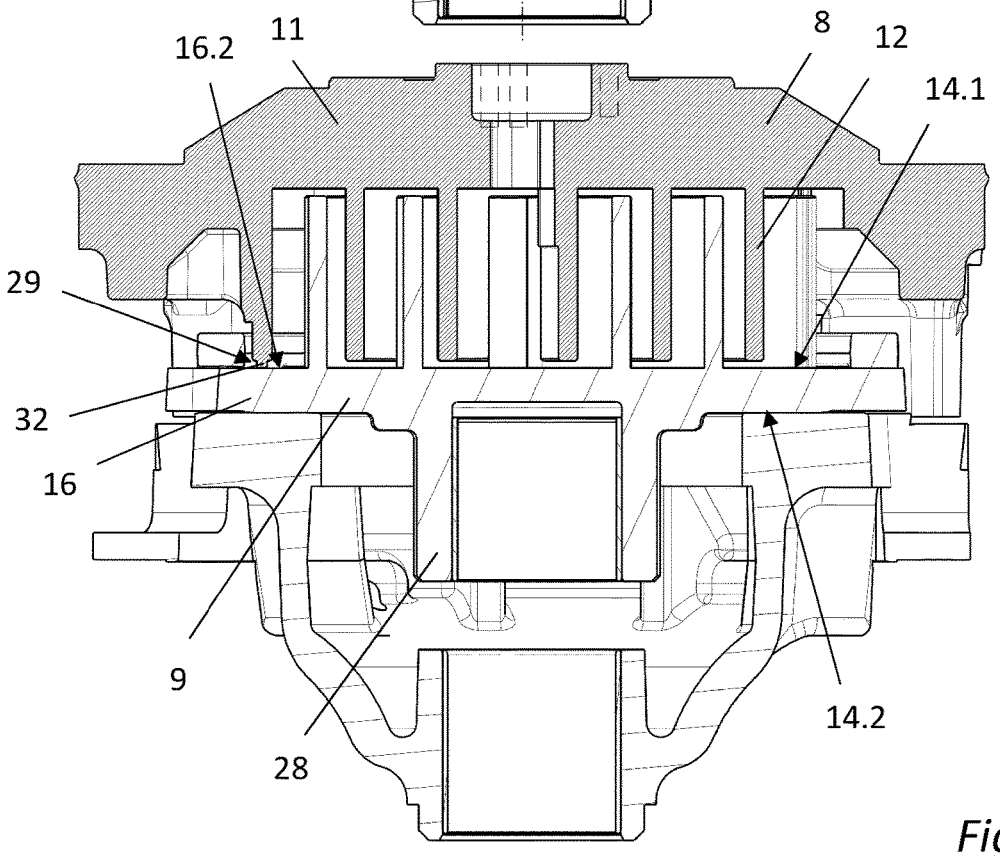
FIG. 3 is a partial longitudinal section view of the scroll compressor of FIG. 1 along a second section plan.
Figure 4:
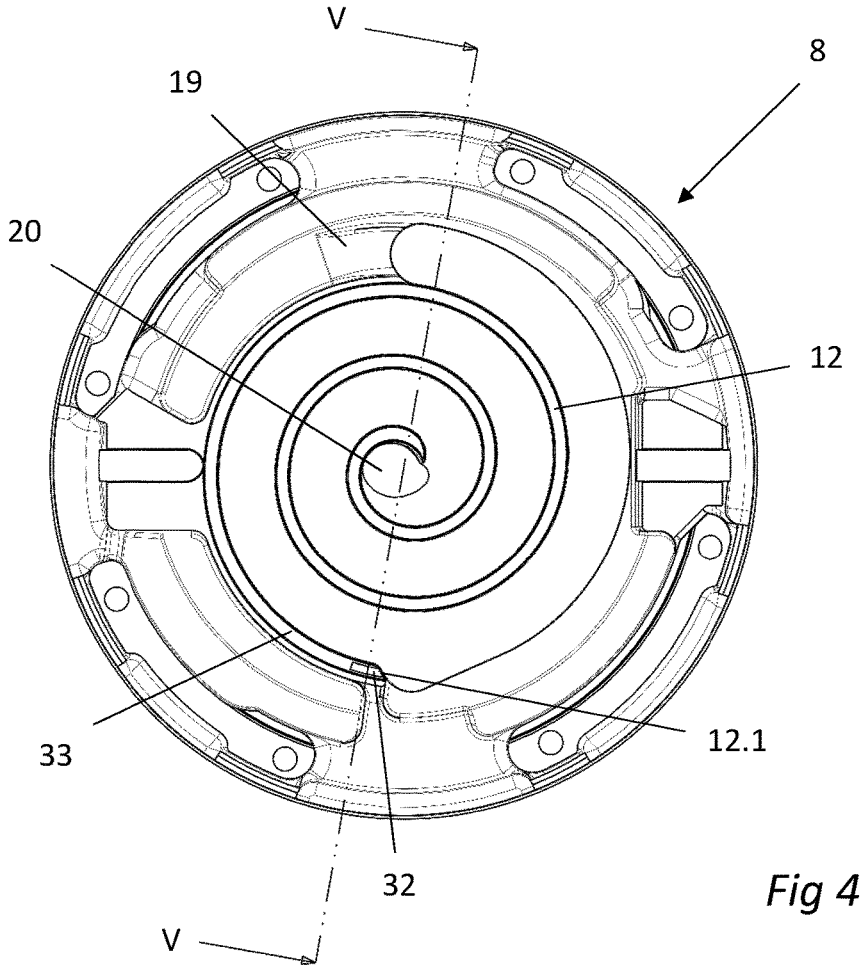
FIG. 4 is a lower view of a fixed scroll of the scroll compressor of FIG. 1.
Figure 5:
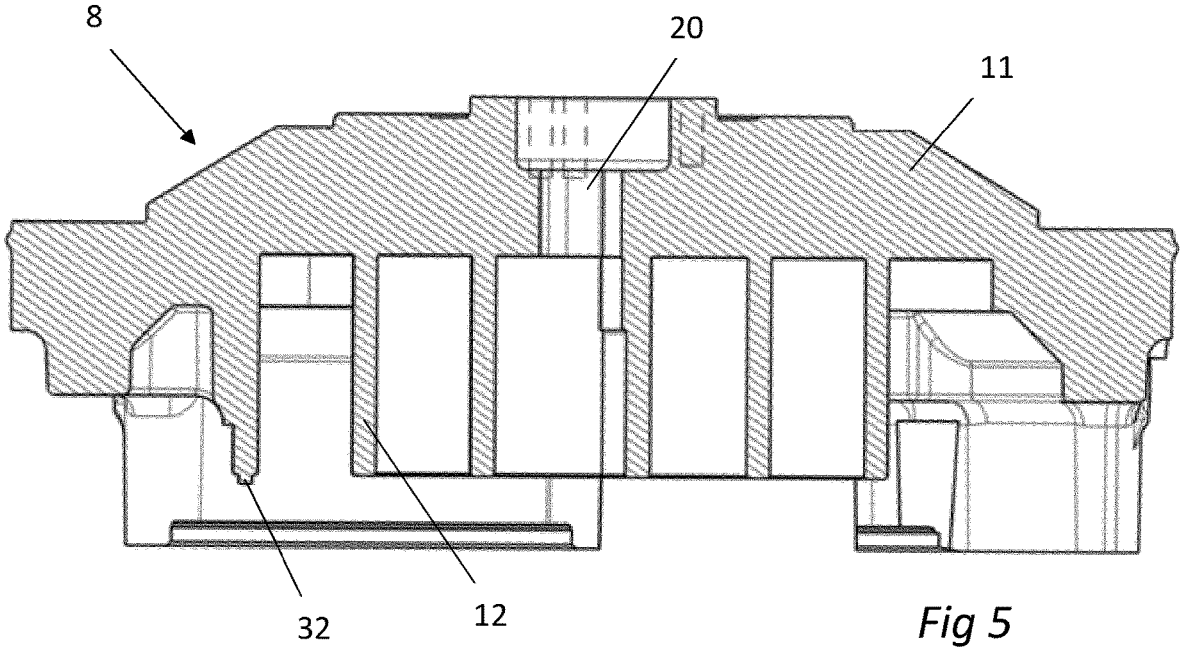
FIG. 5 is a section view according to line V-V of FIG. 4.

As better shown on FIG. 2, the first axial stabilizing arrangement 29 is formed between the flange portion 16 of the orbiting base plate 14 and a portion of the fixed spiral wrap 12 of the fixed scroll 8, and includes a single first stabilizer pad 32 which is formed on an axial end face 33 of the fixed spiral wrap 12 of the fixed scroll 8, and which is configured to cooperate with an axial surface on a first side 16.1 of the flange portion 16 of the orbiting base plate 14. Advantageously, the single first stabilizer pad 32 is arranged near an outer end 12.1 of the fixed spiral wrap 12 and in a portion of the axial end face 33 of the fixed spiral wrap 12, where no tip seal groove is formed.

According to the first embodiment of the invention, the single first stabilizer pad 32 is integrally formed with the fixed spiral wrap 12 of the fixed scroll 8 and is a surface area elevated from the surrounding surface of the fixed spiral wrap 12 of the fixed scroll 8. However, according to another embodiment of the invention, the single first stabilizer pad 32 may be formed as a separate part attached to the fixed spiral wrap 12 of the fixed scroll 8, for example by welding, brazing, gluing, coating or other deposition methods.

As better shown on FIG. 1, the second axial stabilizing arrangement 31 is formed between a portion of the orbiting spiral wrap 15 of the orbiting scroll 9 and the fixed end plate 11 of the fixed scroll 8. Advantageously, the second axial stabilizing arrangement 31 is arranged at a position substantially opposite to the position of the first axial stabilizing arrangement 29 in relation to a center axis A of the orbiting scroll 9. Such a configuration of the first and second axial stabilizing arrangements 29, 31 substantially improves the axial stability of the orbiting scroll 9.

According to the first embodiment of the invention, the second axial stabilizing arrangement 31 includes a single second stabilizer pad 34 which is formed on an axial end face 35 of the orbiting spiral wrap 15 of the orbiting scroll 9, and which is configured to cooperate with a bottom surface 36 of the fixed end plate 11. Advantageously, the single second stabilizer pad 34 is arranged near an outer end 15.2 of the orbiting spiral wrap 15 and in a portion of the axial end face 35 of the orbiting spiral wrap 15, where no tip seal groove is formed.

According to the first embodiment of the invention, the single second stabilizer pad 34 is integrally formed with the orbiting spiral wrap 15 and is a surface area elevated from the surrounding surface of the orbiting spiral wrap 15. However, according to another embodiment of the invention, the single second stabilizer pad 34 may be formed as a separate part attached to the orbiting spiral wrap 15, for example by welding, brazing, gluing, coating or other deposition methods.

According to an embodiment of the invention not shown on the drawings, the first axial stabilizing arrangement 29 may include at least one first stabilizer pad 32 formed on an axial surface on the first side 16.1 of the flange portion 16 of the orbiting base plate 14, and configured to cooperate with an axial surface of the fixed spiral wrap 12 of the fixed scroll 8, and the second axial stabilizing arrangement 31 may include at least one second stabilizer pad 34 formed on the bottom surface 36 of the fixed end plate 11, and configured to cooperate with the axial end face 35 of the orbiting spiral wrap 15 of the orbiting scroll 9.

FIGS. 8 to 15 represent a scroll compressor 2 according to a second embodiment of the invention which differs from the first embodiment shown on FIGS. 1 to 7 notably in that the scroll compressor 2 is a dual scroll compressor and further comprises an additional fixed scroll 37 having an additional fixed end plate 38, an additional fixed spiral wrap 39 extending from the additional fixed end plate 38, and an outer peripheral wall 41 extending from the additional fixed end plate 38 and surrounding the additional fixed spiral wrap 39, and in that the orbiting scroll 9 further has an additional orbiting spiral wrap 42 which extends from a second face 14.2 of the orbiting base plate 14 and which meshes with the additional fixed spiral wrap 39 of the additional fixed scroll 37 to form compression chambers 43.

Figure 9:
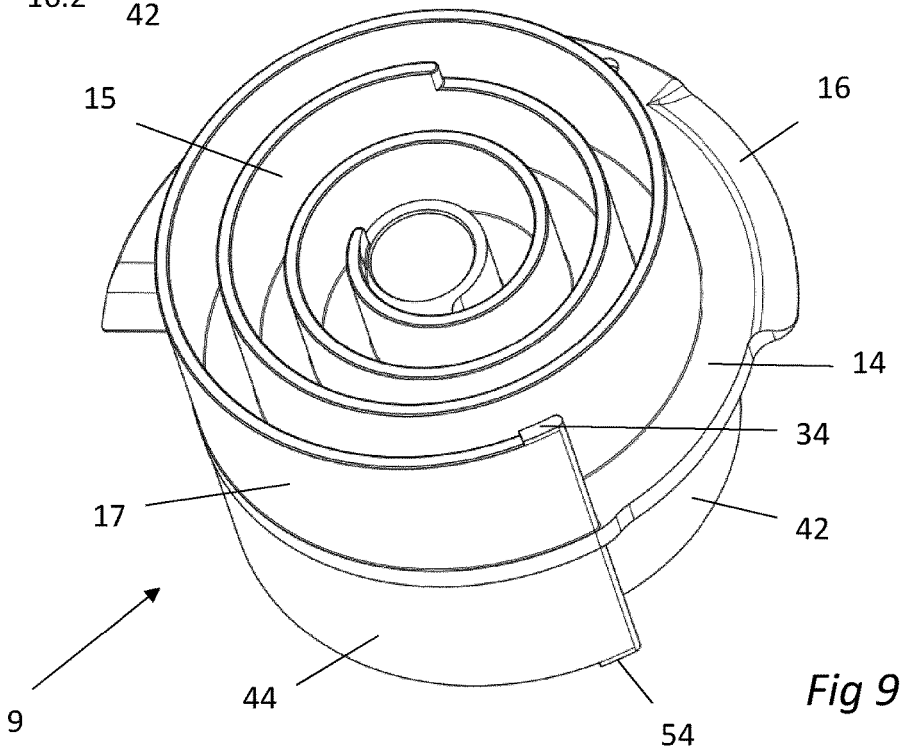
FIG. 9 is a perspective view of an orbiting scroll of the scroll compressor of FIG. 8.
Figure 10:
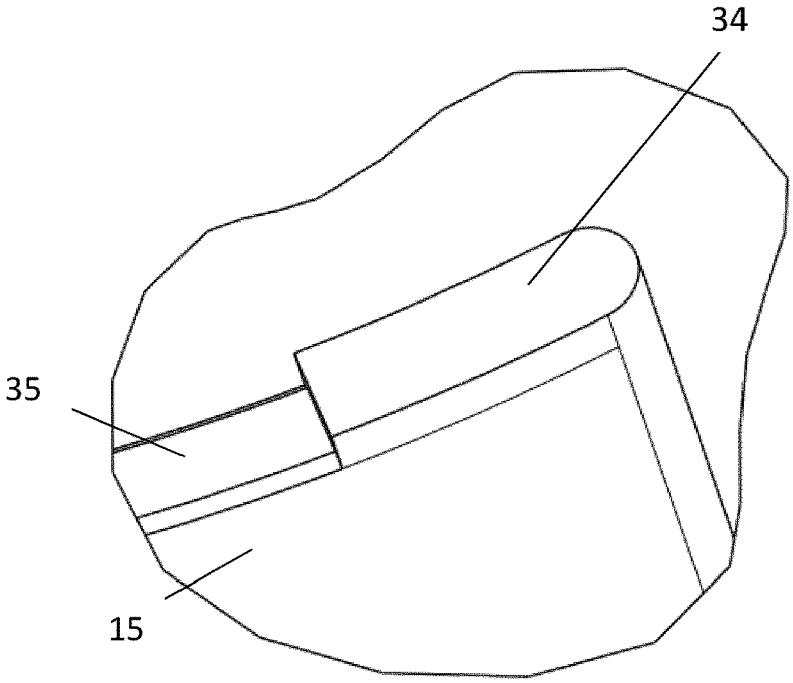
FIG. 10 is an enlarged view of a detail of FIG. 9.
Figure 11:
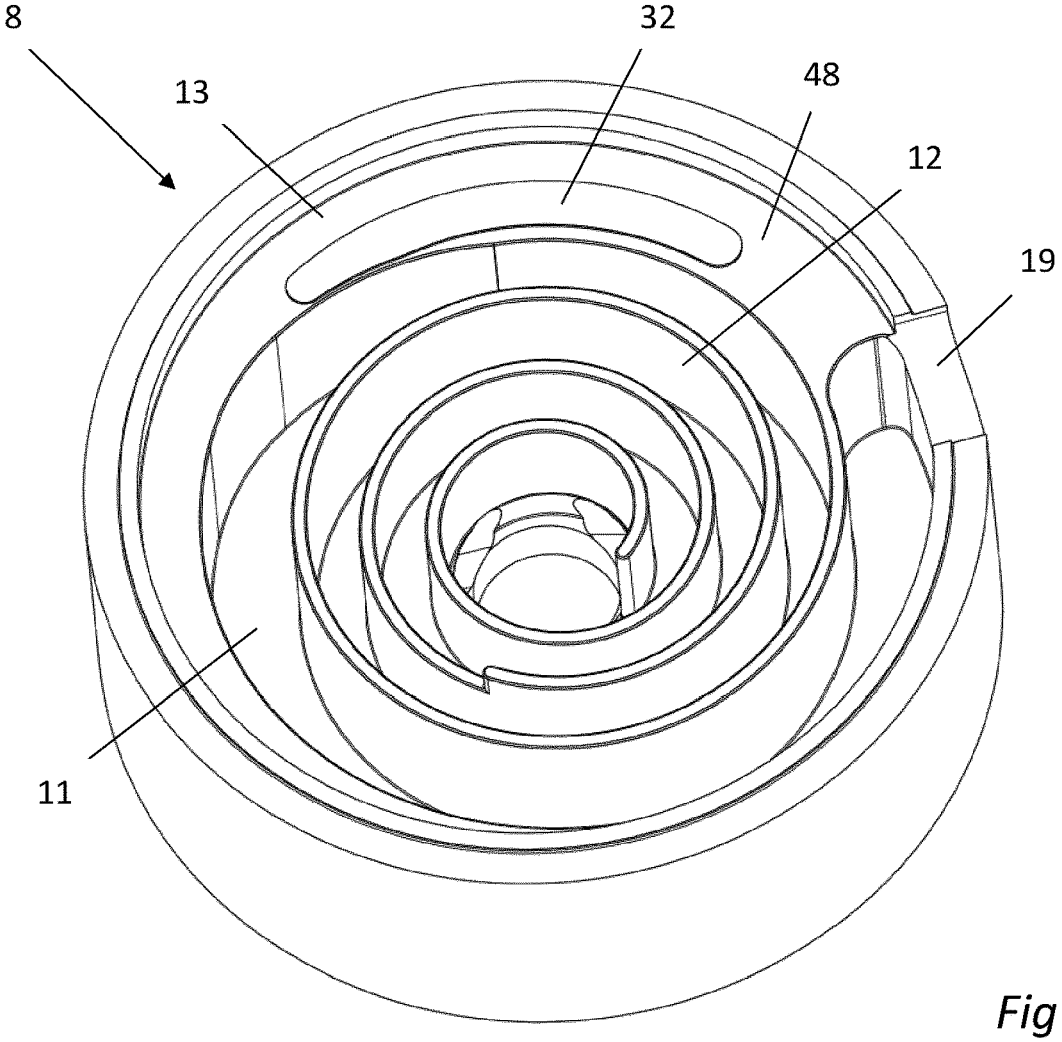
FIG. 11 is a perspective view from below of a fixed scroll of the scroll compressor of FIG. 8.
Figure 12:
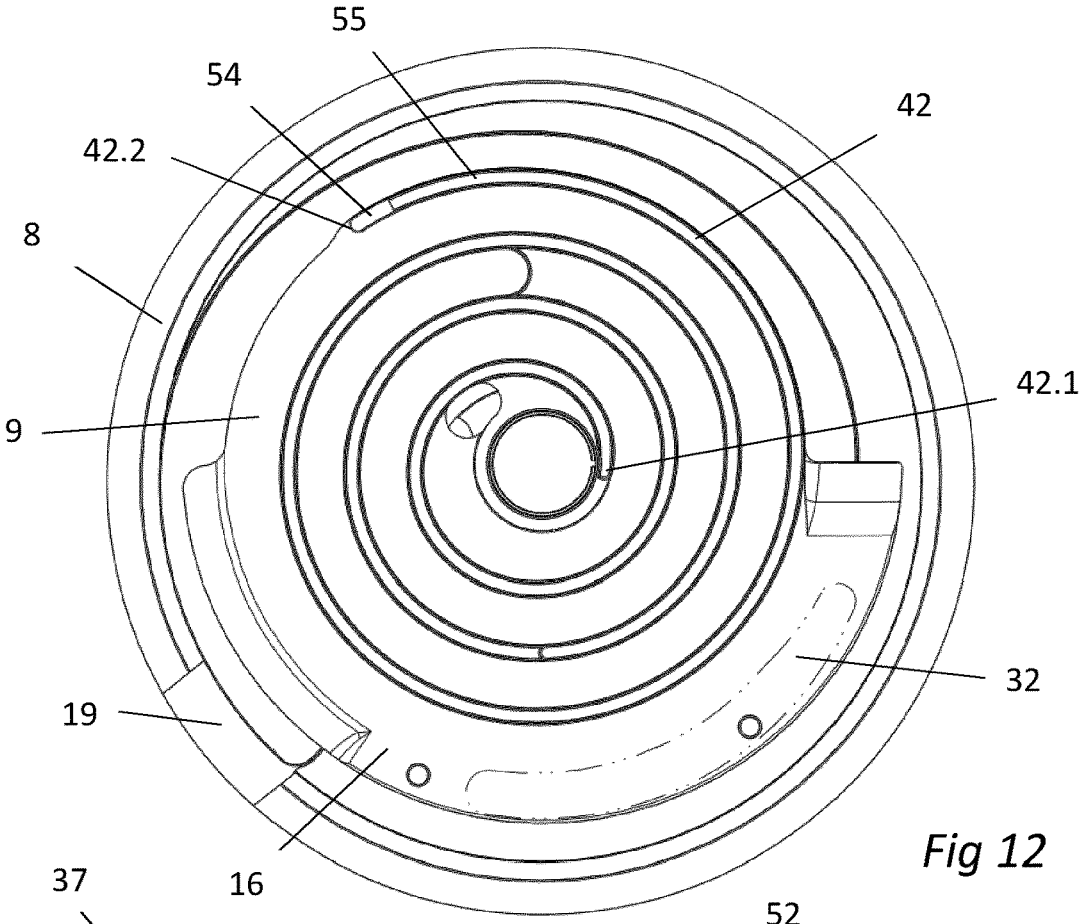
FIG. 12 is a lower view of the fixed scroll and the orbiting scroll of the scroll compressor of FIG. 8.

As better shown on FIG. 9, the flange portion 16 radially extends on only a part of the circumference of the orbiting base plate 14 and beyond an outer wall surface 44 of the additional orbiting spiral wrap 42.

According to the second embodiment of the invention, the fixed scroll 8 and the additional fixed scroll 37 are attached to each other and delimit an inner volume 45 in which is arranged the orbiting scroll 9.

The scroll compressor 2 further comprises an additional suction inlet opening 46 formed in the outer peripheral wall 41 of the additional fixed scroll 37 to supply refrigerant gas to the compression chambers 43. The suction inlet opening 19 and the additional suction inlet opening 46 could be made by a common suction inlet opening formed at an axial height of the orbiting base plate 14 of the orbiting scroll 9. Alternatively, the suction inlet opening 19 and the additional suction inlet opening 46 may be separated from each other.

The scroll compressor 2 further comprises an additional discharge opening 47 formed in the additional fixed end plate 38 of the additional fixed scroll 37 at a position near an inner end 42.1 of the additional orbiting spiral wrap 42 to discharge compressed refrigerant.

According to the second embodiment of the invention, the first axial stabilizing arrangement 29 is formed between the flange portion 16 of the orbiting base plate 14 and the outer peripheral wall 13 of the fixed scroll 8, and includes a single first stabilizer pad 32 formed on the outer peripheral wall 13 of the fixed scroll 8. Advantageously, the single first stabilizer pad 32 is formed on an axial surface 48 of the outer peripheral wall 13 of the fixed scroll 8, and is configured to cooperate with an axial surface on the first side 16.1 of the flange portion 16 of the orbiting base plate 14.

According to the second embodiment of the invention, the scroll compressor 2 further comprises a third and a fourth axial stabilizing arrangement 49, 51 configured to axially stabilize the orbiting scroll. Advantageously, the first and third axial stabilizing arrangements 29, 49 are axially offset relative to each other and are located substantially at a same angular position with respect to the center axis of the fixed scroll 8, and the second and fourth axial stabilizing arrangements 31, 51 are axially offset relative to each other and are located substantially at a same angular position with respect to the center axis A of the orbiting scroll 9.

Figure 8:
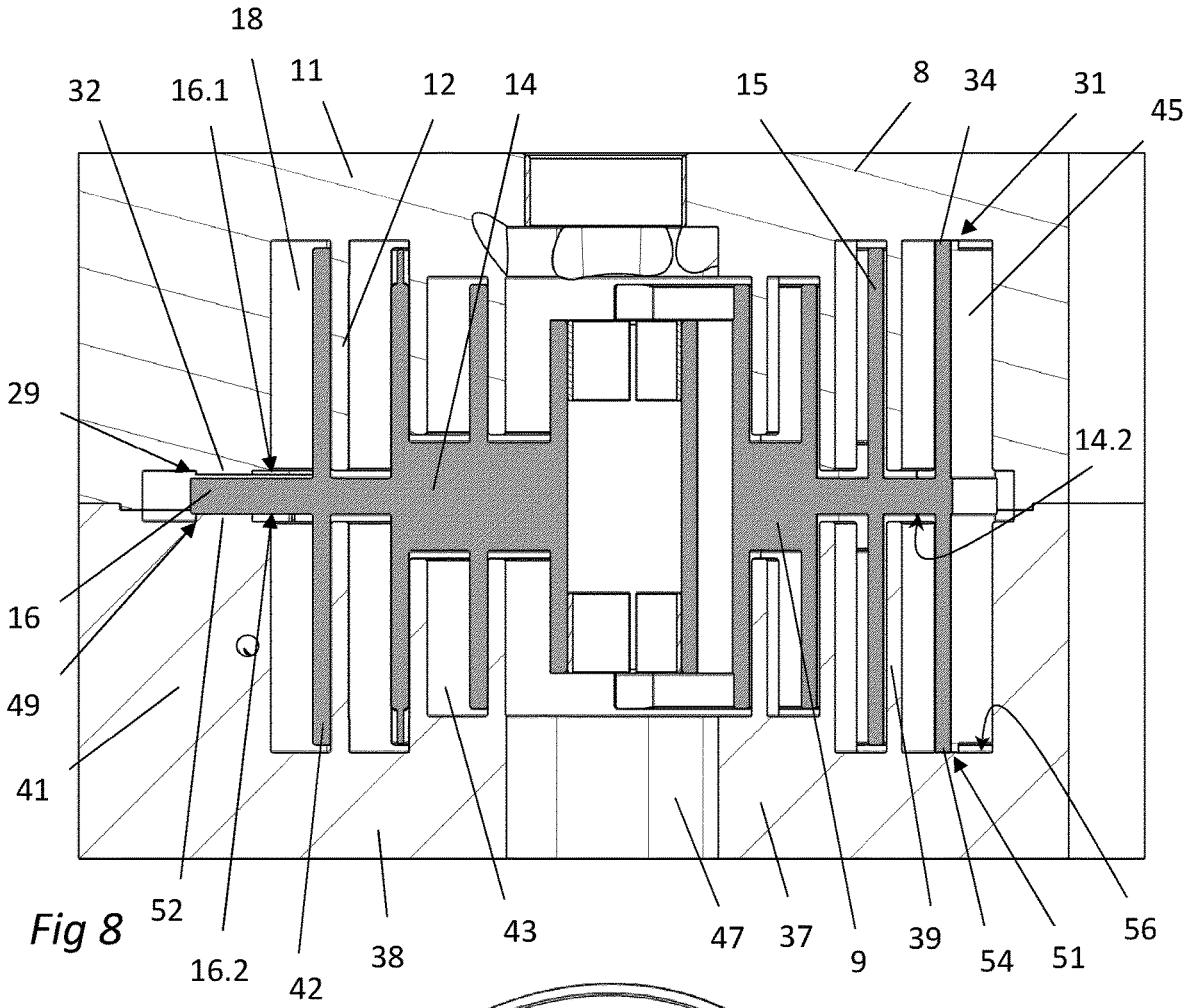
FIG. 8 is a partial longitudinal section view of the scroll compressor according to a second embodiment of the invention.
Figure 13:
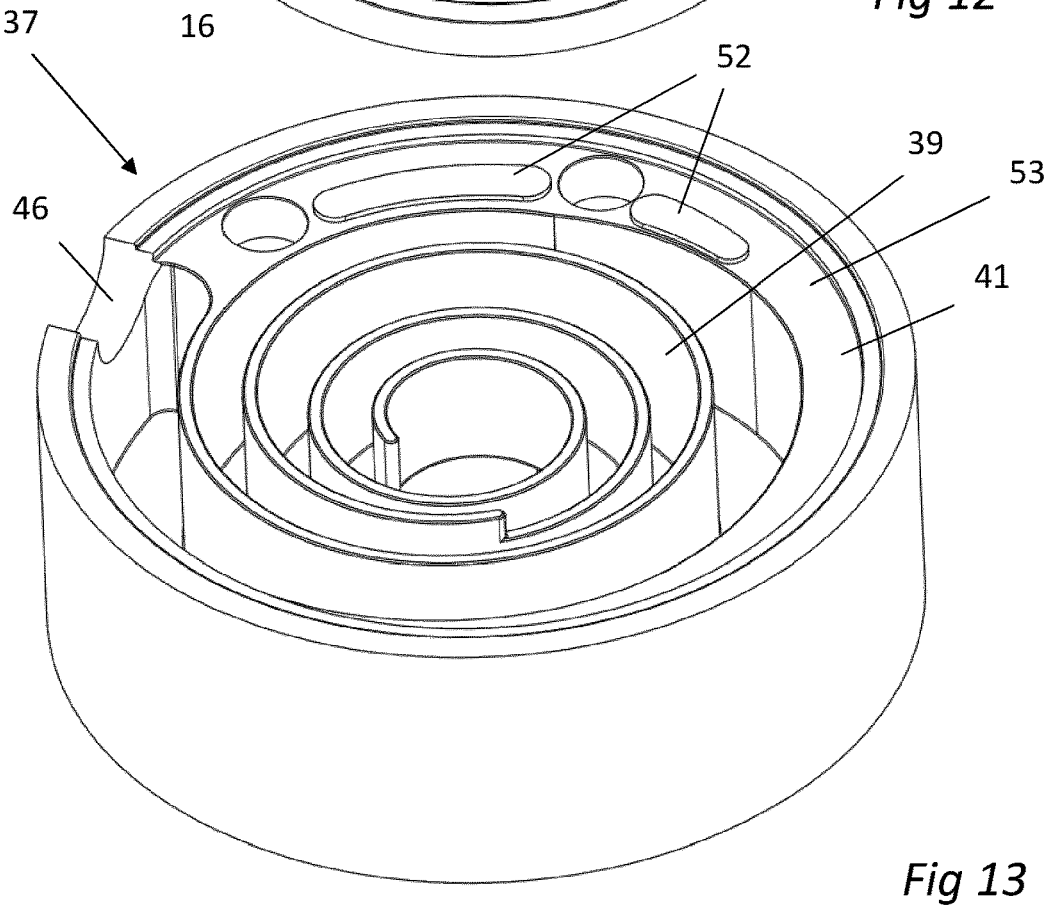
FIG. 13 is a perspective view from above of an additional fixed scroll of the scroll compressor of FIG. 8.
Figure 14:
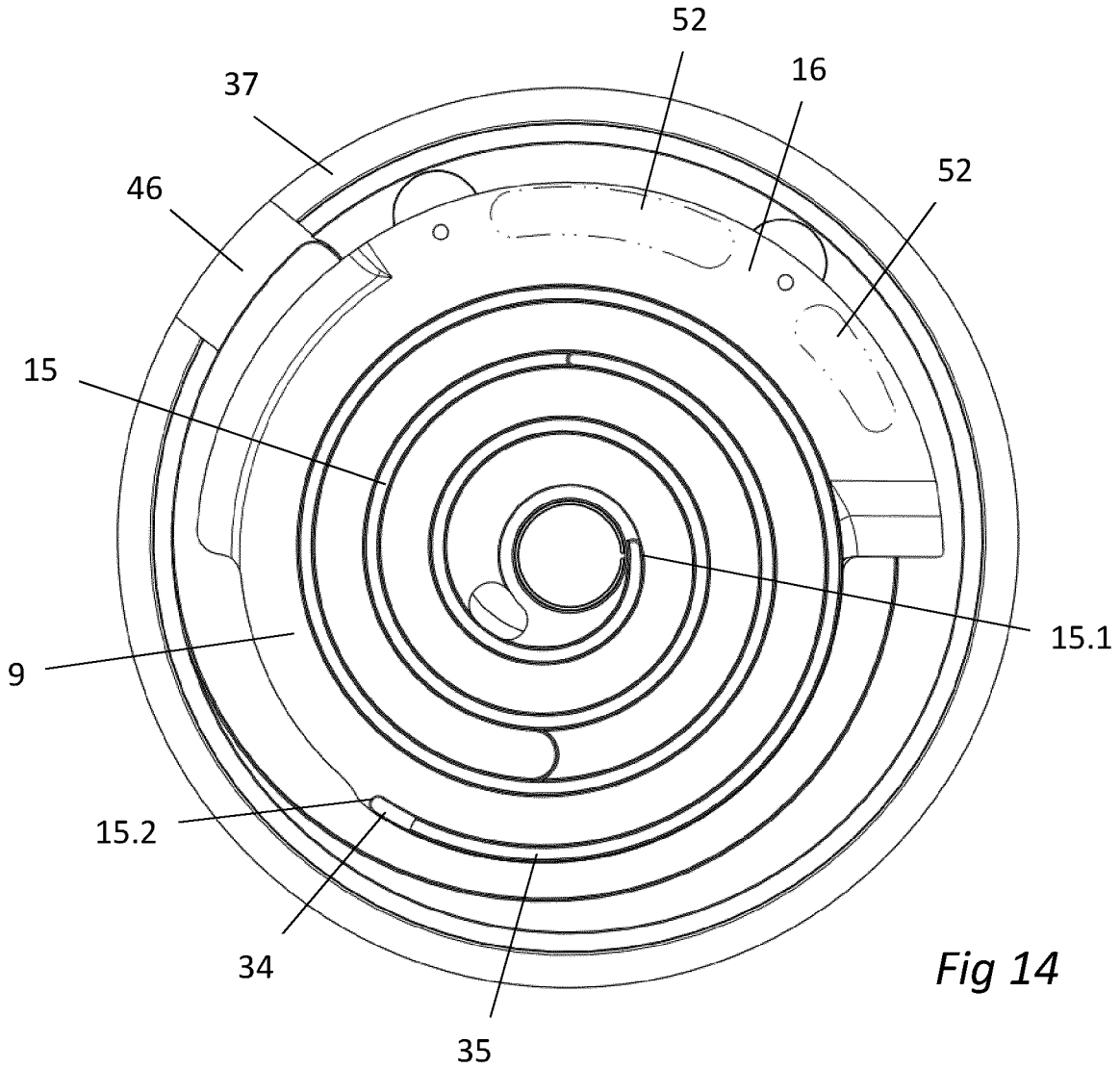
FIG. 14 is an upper view of the additional fixed scroll and the orbiting scroll of the scroll compressor of FIG. 8.

As better shown on FIGS. 8 and 13, the third axial stabilizing arrangement 49 is formed between the flange portion 16 of the orbiting base plate 14 and the outer peripheral wall 41 of the additional fixed scroll 37, and includes two third stabilizer pads 52 formed on the outer peripheral wall 41 of the additional fixed scroll 37 and arranged at a predetermined circumferential distance. Advantageously, the two third stabilizer pads 52 are formed on an axial surface 53 of the outer peripheral wall 41 of the additional fixed scroll 37, and are configured to cooperate with an axial surface on a second side 16.2 of the flange portion 16 of the orbiting base plate 14.

According to the second embodiment of the invention, each of the two third stabilizer pads 52 is integrally formed with the additional fixed scroll 37 and is a surface area elevated from the surrounding surface of the outer peripheral wall 41 of the additional fixed scroll 37. However, according to another embodiment of the invention, each of the two third stabilizer pads 52 may be formed as a separate part attached to the outer peripheral wall 41 of the additional fixed scroll 37, for example by welding, brazing, gluing, coating or other deposition methods.

As better shown on FIGS. 8 and 9, the fourth axial stabilizing arrangement 51 is formed between a portion of the additional orbiting spiral wrap 42 of the orbiting scroll 9 and the additional fixed end plate 38 of the additional fixed scroll 37, and is arranged at a position substantially opposite to the position of the third axial stabilizing arrangement 49 in relation to the center axis A of the orbiting scroll 9.

The fourth axial stabilizing arrangement 51 includes a single fourth stabilizer pad 54 which is formed on an axial end face 55 of the additional orbiting spiral wrap 42 of the orbiting scroll 9, and which is configured to cooperate with a bottom surface 56 of the additional fixed end plate 38. Advantageously, the single fourth stabilizer pad 54 is arranged near an outer end 42.2 of the additional orbiting spiral wrap 42 and in a portion of the axial end face 55 of the additional orbiting spiral wrap 42, where no tip seal groove is formed.

According to the second embodiment of the invention, the single fourth stabilizer pad 54 is integrally formed with the additional orbiting spiral wrap 42 and is a surface area elevated from the surrounding surface of the additional orbiting spiral wrap 42. However, according to another embodiment of the invention, the single fourth stabilizer pad 54 may be formed as a separate part attached to the additional orbiting spiral wrap 42, for example by welding, brazing, gluing, coating or other deposition methods.

Figure 15:
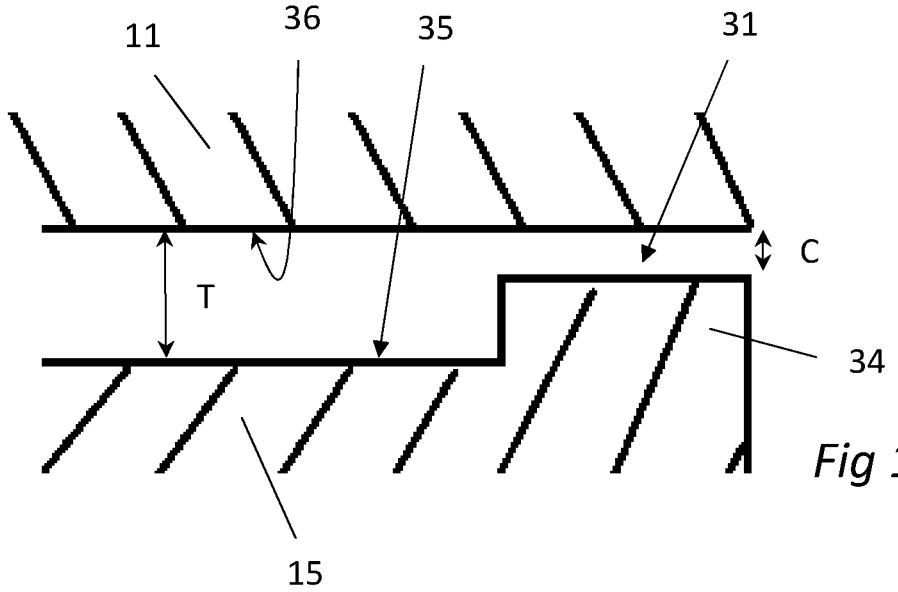
FIG. 15 is a partial cross section of the scroll compressor of FIG. 8.

As shown on FIG. 15, an axial clearance C between the second axial stabilizing arrangement 31 and the bottom surface 36 of the fixed end plate 11 is expressed with following equation:

$$0 \leq C < T,$$

where T is an axial clearance between the axial end face 35 of the orbiting spiral wrap 15 and a respective axial facing surface (i.e., the bottom surface 36) of the fixed end plate 11. Such a configuration of the scroll compressor 2 ensures a proper operation of the scroll compressor 2 and avoids of wobbling.

According to an embodiment not shown on the drawings, the first axial stabilizing arrangement 29 may include at least one first stabilizer pad 32 formed on an axial surface on the first side 16.1 of the flange portion 16 of the orbiting base plate 14, and configured to cooperate with an axial surface of the outer peripheral wall 13 of the fixed scroll 8, and the third axial stabilizing arrangement 49 may include at least one third stabilizer pad 52 formed on an axial surface on the second side 16.2 of the flange portion 16 of the orbiting base plate 14, and configured to cooperate with an axial surface of the outer peripheral wall 41 of the additional fixed scroll 37.

According to an embodiment not shown on the drawings, the fourth axial stabilizing arrangement 51 may include at least one fourth stabilizer pad 54 formed on the bottom surface 56 of the additional fixed end plate 38, and configured to cooperate with the axial end face 55 of the additional orbiting spiral wrap 42 of the orbiting scroll 9.

Of course, the invention is not restricted to the embodiments described above by way of non-limiting examples, but on the contrary, it encompasses all embodiments thereof.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A scroll compressor comprising:

a fixed scroll having a fixed end plate and a fixed spiral wrap extending from the fixed end plate, an orbiting scroll having an orbiting base plate and an orbiting spiral wrap extending from a first face of the orbiting base plate, the orbiting spiral wrap of the orbiting scroll meshing with the fixed spiral wrap of the fixed scroll to form compression chambers, the orbiting base plate comprising a flange portion radially extending on at least part of the circumference of the orbiting base plate and beyond an outer wall surface of the orbiting spiral wrap, wherein the scroll compressor further comprises a first and a second axial stabilizing arrangement configured to axially stabilize the orbiting scroll, the first axial stabilizing arrangement being formed between the flange portion of the orbiting base plate and the fixed scroll, and the second axial stabilizing arrangement being formed between a portion of the orbiting spiral wrap of the orbiting scroll and the fixed end plate of the fixed scroll.

2. The scroll compressor according to claim 1, wherein the fixed scroll includes an outer peripheral wall extending from the fixed end plate and surrounding the fixed spiral wrap.

3. The scroll compressor according to claim 2, wherein the first axial stabilizing arrangement is formed between the flange portion of the orbiting base plate and the outer peripheral wall of the fixed scroll.

4. The scroll compressor according to claim 3, wherein the first axial stabilizing arrangement includes at least one first stabilizer pad formed on the flange portion of the orbiting base plate and/or on the outer peripheral wall of the fixed scroll.

5. The scroll compressor according to claim 4, wherein the at least one first stabilizer pad is formed on an axial surface of the outer peripheral wall of the fixed scroll, and is configured to cooperate with an axial surface on a first side of the flange portion of the orbiting base plate.

6. The scroll compressor according to claim 1, wherein the first axial stabilizing arrangement is formed between the flange portion of the orbiting base plate and a portion of the fixed spiral wrap of the fixed scroll.

7. The scroll compressor according to claim 6, wherein the first axial stabilizing arrangement includes at least one first stabilizer pad which is formed on an axial surface of the fixed spiral wrap of the fixed scroll, and which is configured to cooperate with an axial surface on a first side of the flange portion of the orbiting base plate.

8. The scroll compressor according to claim 7, wherein the at least one first stabilizer pad includes a single first stabilizer pad which is arranged near an outer end of the fixed spiral wrap.

9. The scroll compressor according to claim 1, wherein the second axial stabilizing arrangement is arranged at a position substantially opposite to the position of the first axial stabilizing arrangement in relation to a center axis of the orbiting scroll.

10. The scroll compressor according to claim 1, wherein the second axial stabilizing arrangement includes at least one second stabilizer pad which is formed on an axial surface of the orbiting spiral wrap of the orbiting scroll, and which is configured to cooperate with a bottom surface of the fixed end plate.

11. The scroll compressor according to claim 10, wherein the at least one second stabilizer pad includes a single second stabilizer pad which is arranged near an outer end of the orbiting spiral wrap.

12. The scroll compressor according to claim 1, further comprising an additional fixed scroll having an additional fixed end plate and an additional fixed spiral wrap extending from the additional fixed end plate, the orbiting scroll having an additional orbiting spiral wrap which extends from a second face of the orbiting base plate and which meshes with the additional fixed spiral wrap of the additional fixed scroll to form compression chambers.

13. The scroll compressor according to claim 12, further comprising a third and a fourth axial stabilizing arrangement configured to axially stabilize the orbiting scroll, the third axial stabilizing arrangement being formed between the flange portion of the orbiting base plate and the additional fixed scroll, and the fourth axial stabilizing arrangement being formed between a portion of the additional orbiting spiral wrap of the orbiting scroll and the additional fixed end plate of the additional fixed scroll.

14. The scroll compressor according to claim 13, wherein the fourth axial stabilizing arrangement is arranged at a position substantially opposite to the position of the third axial stabilizing arrangement in relation to the center axis of the orbiting scroll.

15. The scroll compressor according to claim 12, wherein the fixed scroll and the additional fixed scroll are attached to each other and delimit an inner volume, the orbiting scroll being arranged within the inner volume.

16. The scroll compressor according to claim 1, wherein an axial clearance between the second axial stabilizing arrangement and a respective axial facing surface of the fixed scroll or of the orbiting scroll is expressed with following equation:

$$0 \leq C < T,$$

where T is an axial clearance between an axial end face of the orbiting spiral wrap and a respective axial facing surface of the fixed end plate.

* * * * *